United States Patent [19]

Auer et al.

[11] Patent Number: 4,856,197

[45] Date of Patent: Aug. 15, 1989

[54] DRAWING DEVICE HAVING RETRACTABLE STYLUS

[75] Inventors: Robert T. Auer, East Stroudsburg, Pa.; Richard J. Mayer, Parsippany, N.J.

[73] Assignee: Buddy L Corporation, New York, N.Y.

[21] Appl. No.: 193,879

[22] Filed: May 13, 1988

[51] Int. Cl.[4] ..... B43L 13/00

[52] U.S. Cl. ..... 33/18.1; 33/1 M; 33/23.03; 346/139 B

[58] Field of Search ..... 33/18.1, 1 M, 23.03; 346/21, 29, 139 R, 139 B

[56] References Cited

U.S. PATENT DOCUMENTS

| | | | |
|---|---|---|---|
| 3,055,113 | 9/1962 | Grandjean | 33/18.1 |
| 3,331,082 | 7/1967 | Sheets | 346/139 B |
| 3,360,799 | 12/1967 | Polster | 346/139 B |
| 3,760,505 | 9/1973 | Clark | 33/18.1 |
| 3,900,853 | 8/1975 | White | 346/29 |
| 4,135,303 | 1/1979 | Gresset | 33/18.1 |
| 4,356,632 | 11/1982 | Anderka | 33/1 M |
| 4,364,176 | 12/1982 | Cassagones et al. | 33/18.1 |
| 4,451,985 | 6/1984 | Pullman | 33/18.1 |
| 4,550,503 | 11/1985 | Klawitter | 33/18.1 |
| 4,759,131 | 7/1988 | Fend | 33/18.1 |

*Primary Examiner*—William A. Cuchlinski, Jr.
*Assistant Examiner*—Thomas B. Will
*Attorney, Agent, or Firm*—Michael Ebert

[57] ABSTRACT

A drawing device adapted to produce line drawings or sketches on a transparent screen on top of a rectangular box-like case partly filled with a powder that adheres slightly to the undersurface of the screen to render it opaque. Disposed within the case is a stylus supported for sliding movement at the intersection of shiftable transverse and longitudinal rods. The extremities of the transverse rods are fastened to a set of parallel branches of a string loop operated by a control knob which when turned causes this rod and the stylus born thereby to move toward either end of the case, depending on the direction of knob rotation. The extremities of the longitudinal rod are fastened to a set of parallel branches of a second string loop operated by a second control knob when turned causes this rod and the stylus born thereby to move toward either side of the box, depending on the direction of knob rotation. The moving stylus normally engages the undersurface of the screen and acts to scrape powder therefrom to create a line whose contour depends on the path taken by the stylus under the control of one or both knobs. In order to produce sketches and drawings having discrete elements, a manually-operated interrupter mechanism is provided which when actuated depresses one of the rods to retract the stylus from the screen without, however, inhibiting shifting thereof, whereby it then becomes possible selectively to break the line drawn thereby.

8 Claims, 3 Drawing Sheets

Fig. 1.
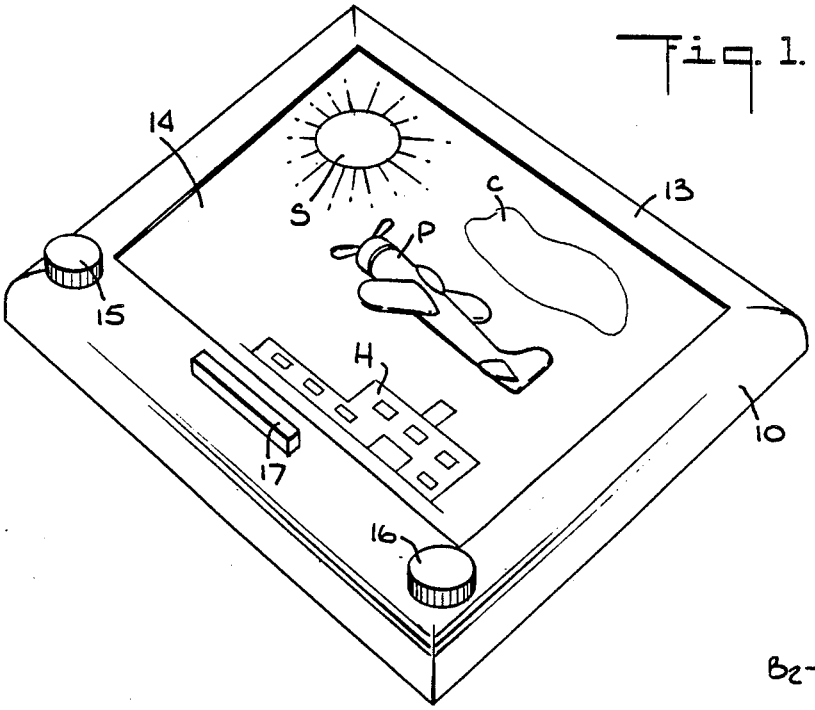
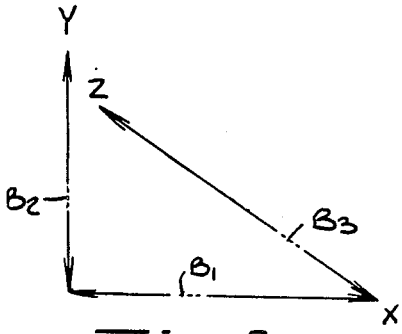
Fig. 6.
Fig. 5.
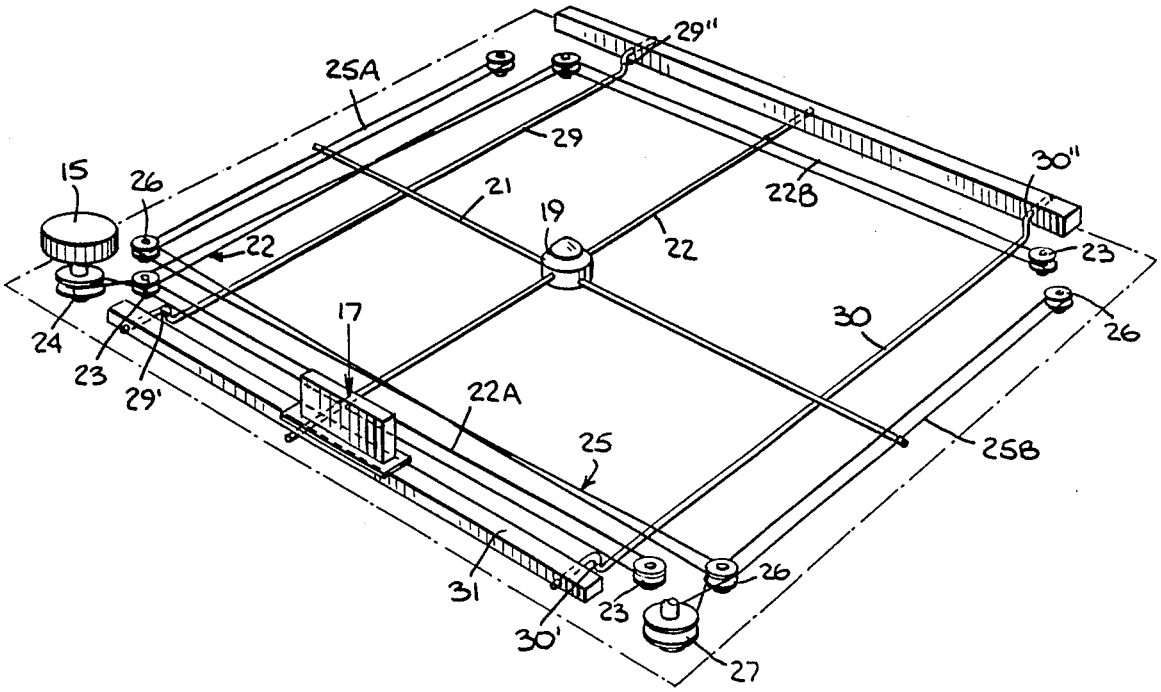

DRAWING DEVICE HAVING RETRACTABLE STYLUS

BACKGROUND OF INVENTION

1. Field of Invention

This invention relates generally to a drawing device having a shiftable stylus adapted to draw on the undersurface of a screen rendered opaque by powders, various line drawings or sketches whose contours depend on the operator-controlled path taken by the stylus as it scrapes powder from the screen, and more particularly to a manually-operated interrupter mechanism which when activated functions to retract the stylus from the screen undersurface without, however, inhibiting shifting of the stylus, thereby making it possible selectively to break the lines on the screen created by the stylus.

2. Status of Prior Art

The Grandjean U.S. Pat. No. 3,305,113, and the Clark U.S. Pat. No. 3,760,505, disclose a tracing device having educational as well as play value. The tracing device includes a box-like case having a transparent top plate or screen next to which are left and right control knobs. By turning these knobs, one can delineate on the screen various letters, charts, designs and other line drawings and sketches.

In a tracing device of this type, one well known version which is commercially available under the trademark Etch-A-Sketch, in order to form a horizontal line in the X-direction on the screen, the operator has only to turn the left knob, while to form a vertical line in the Y direction, he turns the right knob. And to create curves and angles on the screen, these knobs are turned at the same time, thereby causing the stylus to shift in a path which is the vector resultant of the X and Y movements. The terms "drawing" and "tracing" as used herein are interchangeable, as are the terms "shiftable" and "movable".

The case is partly filled with a slightly adhesive powder which sticks onto the undersurface of the screen to render it opaque but is easily dislodged therefrom. The undersurface of the screen is engaged by the movable stylus which under knob control scrapes the powder from the screen to define a line whose contour depends on the operator-controlled path taken by the stylus.

To erase the line drawing or sketch defined by the scraped-off powder on the screen, the case is turned upside down and is shaken to cause the powder to cascade over the undersurface of the screen, to again form an opaque coating.

The later-issued Clark patent differs from the earlier Grandjean patent mainly in the means incorporated therein to prevent leakage of powder from the tracing device. Both patents, whose entire disclosures are incorporated herein by reference, make use of transverse and longitudinal rods at whose intersection the stylus is mounted for sliding movement. The transverse rod is fastened at its extremities to parallel sections of a first string loop operatively coupled to the left control knob so that as this knob is turned, the transverse rod and the stylus borne thereby are caused to move toward either side of the box, depending on the direction of knob rotation, thereby drawing a horizontal line on the screen. The longitudinal rod is fastened at its extremities to parallel sections of a second string loop operatively coupled to the second knob so that as this knob is turned, this rod and the stylus borne thereby are caused to move toward either the top or bottom of the box, thereby drawing a vertical line on the screen.

Thus, operation of one knob produces a line in the X-direction on the screen, operation of the other knob produces a line in the Y-direction, and concurrent turning of the knobs produces a line in a Z-direction which is the vector resultant of the X and Y movements of the stylus. The drawing device is therefore capable of creating line drawings or sketches having a desired configuration.

The most serious practical limitation of the tracing device of the type disclosed in the Clark and Grandjean patents as well as in commercially-available devices based on these patents is the inability of these devices selectively to break the line drawn by the stylus. The stylus is urged against the undersurface of the screen under the tension of the string loops supporting the intersecting rods on which the stylus is mounted, and the stylus is never retracted therefrom. Because of this limitation, whatever drawing or sketch is traced on the screen by the operator must be formed by unbroken lines.

To explain why this limitation is troublesome, let us assume that a child wishes to draw with a pencil a simple picture composed of a house at ground level above which is the sun, a cloud and an airplane. These elements of the picture are all discrete and separated from each other in space. If, now, the child wishes to draw the same picture on a standard drawing device in which the stylus effectively performs the function of a pencil, he cannot on the screen of the drawing device create the elements thereof in discrete form, for the stylus never leaves the screen.

Hence, after completing, say, the house, in order to draw the sun the child must now trace a line from the house to a point thereabove before outlining the sun, and do likewise when going from the sun to a cloud, and from the cloud to an airplane. As a consequence, the picture is impaired by connecting lines which serve no artistic purpose but are dictated by the limitations of the tracing device. And when the child wishes with the tracing device to print on the screen an expression such as HAPPY BIRTHDAY, the letters cannot be separately traced but must be joined together as in cursive writing. Thus, however the knobs are manipulated, the operator can never lift the stylus from the screen as one can lift a pencil from paper.

SUMMARY OF INVENTION

In view of the foregoing, the main object of this invention is to provide a drawing device whose stylus is capable of being moved under the control of X-direction and Y-direction knobs to create on a screen various line drawings and sketches having any desired contour, the device including a manually-operated interrupter mechanism which when actuated acts to retract the stylus from the screen without inhibiting movement of the stylus under knob control.

A significant advantage of the invention is that it makes possible the formation on the screen a drawing or sketch composed of discrete, multiple elements without the need to interconnect these elements with lines as in prior tracing or drawing devices.

Also an object of the invention is to provide an interrupter mechanism that is of simple and inexpensive construction, the nature of this mechanism being such that it can be added to an existing drawing device including string-manipulated transverse and longitudinal rods for supportint the stylus without any substantial modification thereto.

Yet another object of the invention is to provide a drawing device which operates efficiently and reliably and includes left and right control knobs to effect stylus movement and an interrupter actuator selectively to break the lines drawn by the stylus.

Briefly stated, these objects are attained in a drawing device adapted to produce line drawings or sketches on a transparent screen on top of a rectangular box-like case partly filled with a powder that adheres slightly to the undersurface of the screen to render it opaque. Disposed within the case is a stylus supported for sliding movement at the intersection of shiftable transverse and longitudinal rods. The extremities of the transverse rods are fastened to a set of parallel branches of a string loop operated by a control knob which when turned causes this rod and the stylus borne thereby to move toward either side of the case, depending on the direction of knob rotation. The extremities of the longitudinal rod are fastened to a set of parallel branches of a second string loop operated by a second control knob which when turned causes this rod and the stylus borne thereby to shift toward either the top or bottom of the box, depending on the direction of knob rotation. The moving stylus normally engages the undersurface of the screen and acts to scrape powder therefrom to create a line whose contour depends on the path taken by the stylus under the control of one or both knobs. In order to produce sketches and drawings having discrete elements, a manually-operated interrupter mechanism is provided which when actuated depresses one of the rods to retract the stylus from the screen without, however, inhibiting shifting thereof, whereby it then becomes possible selectively to break the line drawn thereby.

BRIEF DESCRIPTION OF DRAWINGS

For a better understanding of the invention as well as other objects and further features thereof, reference is made to the following detailed description to be read in conjunction with the accompanying drawings, wherein:

FIG. 1 shows, in perspective, a drawing device in accordance with the invention;

FIG. 5 illustrates in perspective view the interrupter mechanism; and

FIG. 6 is a pattern of traced lines created by the device.

DESCRIPTION OF INVENTION

Figure 2:
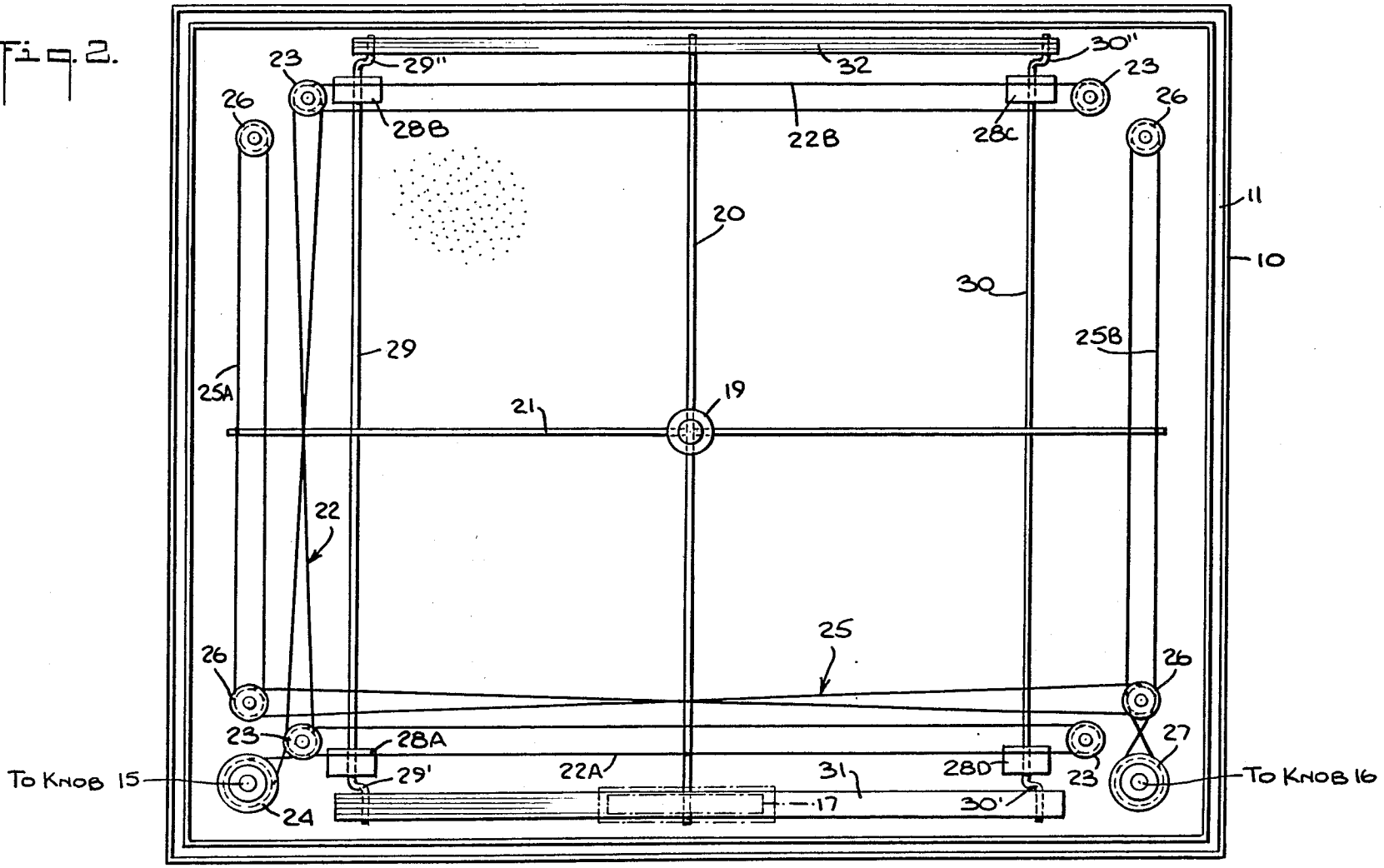
FIG. 2 illustrates in plan view the base tray of the device and the string loops for manipulating the rods supporting the stylus.
Figure 3:
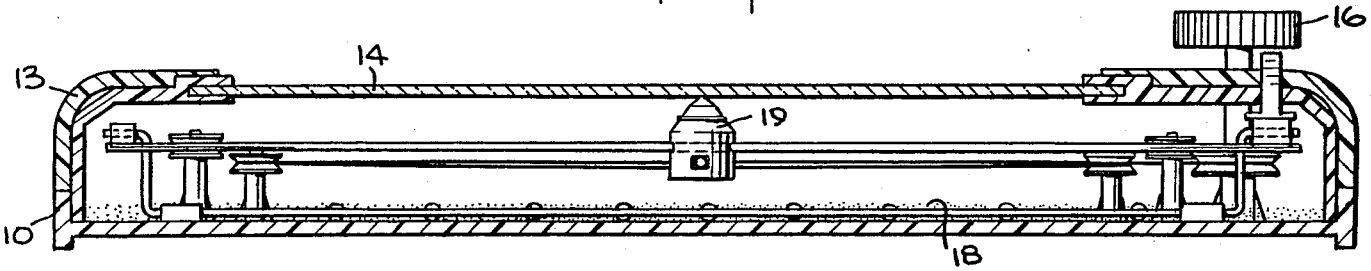
FIG. 3 is a longitudinal section taken through the drawing device showing the stylus in engagement with the undersurface of the screen.

The Basic Assembly:

Referring now to FIGS. 1, 2 and 3, there is shown a drawing device in accordance with a preferred embodiment of the invention. The device includes a rectangular base tray 10 molded of synthetic plastic material of high strength, such as polyvinyl chloride or polystyrene. The tray is provided with a peripheral groove 11 adapted to snugly receive a complementary flange formed on the undersurface of a frame-shaped cover 13 made of similar plastic material. Mounted within the frame of cover 13 is a transparent plate 14 formed of glass or similar clear material functioning as the screen of the device.

The drawing device is provided at a bottom position below screen 14 with a left control knob 15 which when turned produces, as shown in FIG. 6, a horizontal line in the X-direction, and a right control knob 16 which when turned produces a vertical line in the Y-direction. When the two knobs are operated concurrently, the vector resultant of the stylus movements produces a line in a direction Z.

Also included at a bottom position intermediate the left and right control knobs is an actuator bar 17 which when pressed by the user operates an interrupter mechanism which breaks the line then being traced by a stylus 19. This is effected by retracting the stylus from the screen without, however, inhibiting moving of the stylus under the control of the knobs.

Thus, in FIG. 6, there is shown a break $B_1$ in the X-line produced by turning left knob 15, and there is a break $B_2$ in the Y line produced by turning right knob 16. And when both knobs are turned together to form a Z-line, operation of the interrupter produces a break $B_3$ therein. In practice, actuator bar 17 may be lengthened or so placed that it is close to one of the knobs. In this way, the operator can depress the actuator bar with the same hand that is turning the adjacent knob.

The arrangement is such that screen 14 is marginally supported snugly within a molded groove in cover frame 13, and the cover frame, when joined to the base tray, is sealed thereto to create a fluid-tight enclosure. This enclosure is partly filled with a powder 18 of the type disclosed in the Grandjean and Clark patents. The control knob shafts which go through bores in the cover frame and the actuator bar which goes through an opening in the cover frame are provided with suitable sealing gaskets to prevent powder leakage through these openings.

In practice, powder 18 may be a fine metallic powder mixed with small plastic beads to form a mixture that can be shaken up within the enclosure without escaping therefrom. The powder has slightly adhesive properties and therefore, when the device is shaken up in an upside-down state, coats the undersurface of the screen to render it opaque. And when the device is put to use and lines or marks are left on the screen by stylus 19 which scrapes off the powder, the resultant lines or marks may be erased by again shaking up the device in an upside-down state, thereby again rendering the screen opaque in readiness for a new drawing.

As shown in FIG. 2, stylus 19 is supported for sliding movement at the intersection of a transverse rod 20 and a longitudinal rod 21, these rods extending through separate bores in the stylus. The conical upper peak of the stylus is normally pressed against the undersurface of screen 14, by the tension of the strings on which the rods are fastened. Hence, as the rods are manipulated by these strings to shift the stylus, the stylus then scratches off the powder adhered to the undersurface of the screen, thereby making the screen transparent along the powder-free line. Because the user looks into a dark sealed case through the scratch lines, these lines, in contrast to the color of the opaque powder, which may be the color of silver, gold or copper, appear to be black and are therefore clearly visible on the screen.

The extremities of transverse rod 20 are fastened to parallel branches 22A and 22B of a first continuous string loop 22 which is looped around a set of four pulleys 23 mounted for rotation on posts anchored on the base tray 10 at positions adjacent the corners. The first string loop is also looped around a drive pulley 24 on the shaft of the left control knob 15. Hence, by turning this knob, the branches of the loop are caused to advance. As a result, the transverse rod 20 which is fastened to the set of advancing string branches is caused to move toward either end of the tray, and in doing so, causes the stylus borne thereby to scrape a horizontal X-line along the powdered undersurface of the screen.

In a similar manner, longitudinal rod 21 is fastened at its extremities to a set of parallel branches 25A and 25B of a second continuous string loop 25 looped around corner pulley 26 and also around a drive pulley 27 mounted on the shaft of right control knob 16. Hence, by turning knob 16, one causes longitudinal rod 21 to move toward the upper or lower side of the tray, and in doing so causes the stylus to scrape a vertical Y-line along the powdered undersurface of the screen.

By rotating the two knobs in different directions and at different rates, the stylus then traces a line Z whose path or contour depends on the vector resultant of the X-Y movements.

The Interrupter Mechanism:

Referring now to FIGS. 2 and 5, the interrupter mechanism which is actuated by actuator bar 17 is shown in connection with the transverse and horizontal bars 20 and 21 on which stylus 19 is supported. The mechanism includes four small bearing blocks 28A, 28B, 28C and 28D anchored on base tray 10 adjacent the respective corners thereof (shown only in FIG. 2).

Extending between blocks 28A and 28B and borne thereby is an axle 29 whose opposite ends extend beyond the blocks and terminate in L-shaped crank arms 29' and 29''. Similarly extending between bearing blocks 28C and 28D is an axle 30 whose opposite ends terminate in like crank arms 30' and 30''.

Crank arms 29' and 30' are pivotally linked to the opposite ends of a beam 31 parallel to the longitudinal rod 21 which overlies the lower end of transverse rod 20, while crank arms 29'' and 30'' are pivotally linked to the opposite ends of a beam 32 which overlies the upper end of transverse rod 20 and is parallel to beam 31.

The strings which form the loops are formed of nylon fiber or similar wire-like material and are held taut on the pulleys so that the branches of the loop are parallel to the base of tray 10 and maintain the transverse and longitudinal rods at an elevated position in which the stylus under the tension of the string loops is urged against the undersurface of the screen with sufficient pressure to effect a powder scraping action.

When actuator bar 17 which engages beam 31 at its midpoint is pressed down by an operator, this acts to depress beam 31 and the end of transverse bar 20 engaged by the beam against the tension of the string branch underlying the transverse bar. Because beam 31 is supported at its ends by crank arms 29' and 30', this action causes these arms to swing, and in doing so causes crank arms 29'' and 30'' on the axles common thereto to swing to pull down beam 32 engaging the other end of transverse bar 20.

Thus, the combination of parallel beams and crank axles behaves as a cradle which is normally maintained by the string loops at a raised position, but when actuated, is caused to assume a lowered position, the cradle being returned by the string loops to its raised position when the actuator is released.

Figure 4:
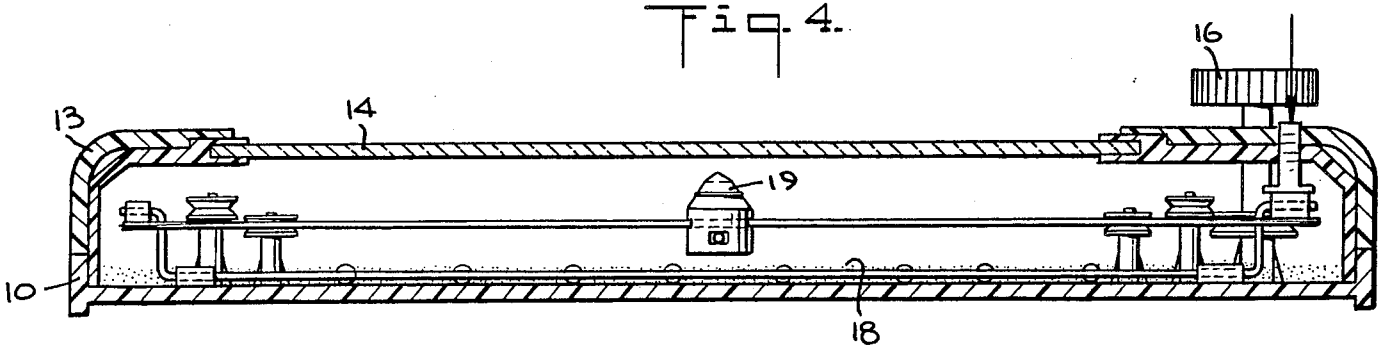
FIG. 4 shows the retracted relationship of the stylus to the screen when the interrupter mechanism is actuated.

As a consequence, stylus 19, which is slidably mounted at the intersection of rods 20 and 21, is retracted, as shown in FIG. 4, from the undersurface of the screen and can no longer scrape powder therefrom.

Beams 31 and 32 are formed of a smooth, synthetic plastic such as PTFE (Teflon) having a low coefficient of friction. Hence, when the interrupter mechanism is actuated and these beams are pressed against the opposite ends of transverse bar 20, this action does not inhibit the ability of this bar to be shifted under the control of left knob 15, and it does not therefore interfere with continued moving of the retracted stylus. In practice, whenever the operator is tracing a line on the screen by turning either the left or right control knob or by turning them together, he can, should he wish to do so in order to break the line being traced, actuate the interrupter mechanism. And when the actuator bar is released, the stylus again engages the screen.

Alternatively, the interrupter mechanism may be arranged to press down on the longitudinal rod rather than the transverse rod. Thus, it becomes possible, as shown by the sample drawing in FIG. 1, to create a multi-element drawing composed of a house H at ground level, and in the space thereabove, a plane P, a cloud C and a sun S, all of these elements being discrete and unconnected by lines.

While there has been shown and described a preferred embodiment of a drawing device having retractable stylus in accordance with the invention, it will be appreciated that many changes and modifications may be made therein without, however, departing from the essential spirit thereof.

I claim:

1. A drawing device for producing line drawings or sketches, said device comprising:

(A) a box-like case provided at its top with a transparent screen, said case being partly filled with a slightly adhesive powder that adheres to the undersurface of the screen to render it opaque, which powder can readily be dislodged by shaking the case or respread on the undersurface;

(B) transverse and longitudinal rods disposed within the case;

(C) a stylus mounted for sliding movement at the intersection of the rods;

(D) a first string loop looped about one set of four pulleys anchored on the vase of the case adjacent the corners thereof to define a first pair of parallel string branches, said transverse rod being fastened at its extremities to these first branches;

(E) a first knob on top of said case operatively coupled to said first loop which when turned causes said transverse bar and the stylus borne thereby to shift toward either end of the case, depending on the direction of turning;

(F) a second string loop looped about another set of four pulleys anchored on the base of the case adjacent the corners thereof to define a second pair of parallel string branches at right angles to the first pair of parallel string branches, said longitudinal rod being fastened at its extremities to these second branches;

(G) a second knob on top of said case operatively coupled to said second loop which when turned causes said longitudinal rod and the stylus borne thereby to shift toward either side of the case, depending on the direction of turning, said first and second loops being tensioned to urge said stylus against the undersurface of the screen to draw a line of powder therefrom in a path determined by operation of the knobs; and (H) an interrupter mechanism within the case manually operated by a single depressible actuator that projects from said case to effect retraction of the stylus to break the traced line as the stylus is being shifted without, however, inhibiting such shifting, said mechanism including means engaging the opposite ends of said rods which when the actuator is manually depressed by an operator acts to depress both ends of said one rod and the stylus borne thereby.

2. A drawing device as set forth in claim 1, wherein said first string loop is also looped about a drive pulley on a shaft to which said first knob is keyed.

3. A drawing device as set forth in claim 1, wherein said second string loop is also looped about a drive pulley on a shaft to which said second knob is keyed.

4. A drawing device as set forth in claim 1, in which said case is formed by a base tray and a cover frame secured thereto for supporting the screen.

5. A drawing device as set forth in claim 4, wherein said cover frame is provided at its underside with a flange that is received in a peripheral groove in the base tray.

6. A drawing device as set forth in claim 5, wherein said cover frame forms a powder-tight seal with said base tray and said screen forms a powder-tight seal with said cover frame.

7. A drawing device as set forth in claim 1, wherein said means is constituted by a pair of parallel beams, one lying over one end of said one of said rods at right angles thereto and the other over the opposite end thereof, and a pair of parallel axles at right angles to the beams supported by bearing blocks anchored on the base of the case, each axle having crank arms on opposite ends thereof which are pivotally linked to the ends of the beams.

8. A drawing device as set forth in claim 7, wherein said beams are of a material having a low coefficient of friction.

* * * * *

UNITED STATES PATENT OFFICE

CERTIFICATE OF CORRECTION

Patent No. 4,856,197 Dated Aug. 15, 1989

Inventor(s) Robert T. Auer & Richard J. Mayer

It is certified that error appears in the above-identified patent and that said Letters Patent is hereby corrected as shown below:

Column 6, line 49, "vase" should read --base--

Signed and Sealed this

Nineteenth Day of December, 1989

*Attest:*

JEFFREY M. SAMUELS

*Attesting Officer* *Acting Commissioner of Patents and Trademarks*